United States Patent [19]

Winzelberg

[11] 4,040,285

[45] Aug. 9, 1977

[54] METHOD AND APPARATUS FOR MAKING JEWELRY BANDS

[75] Inventor: Abraham Winzelberg, Flushing, N.Y.

[73] Assignee: Frank Ellman Co., Inc., New York, N.Y.

[21] Appl. No.: 700,907

[22] Filed: June 29, 1976

[51] Int. Cl.[2] ..... B21D 11/02

[52] U.S. Cl. ..... 72/370; 72/471

[58] Field of Search ..... 72/391, 367, 369, 370, 72/398, 470, 472, 471; 29/8

[56] References Cited

U.S. PATENT DOCUMENTS

| | | | |
|---|---|---|---|
| 140,422 | 7/1873 | Krementz | 29/8 |
| 1,725,592 | 8/1929 | Mertes | 72/370 |
| 1,898,374 | 2/1933 | Kvarnstrom | 72/370 |
| 2,535,470 | 12/1950 | Welshman | 72/370 |

*Primary Examiner*—C.W. Lanham
*Assistant Examiner*—Gene P. Crosby
*Attorney, Agent, or Firm*—Amster & Rothstein

[57] ABSTRACT

Jewelry bands of various polygonal and arcuate shapes are made by forming an annular blank band to the desired shape. Shaping is achieved by forcing the blank rearward and onto an elongated male member having a tapered front portion which merges into a rear portion with a cross-section of the desired shape. The blank is forced rearward by pressing the male member into an aperture in a female member which is shaped to conform to and receive the rear portion of the male member. Compressing the formed blank against the rear portion of the male member makes it conform more closely to the desired shape, and eases removal of the shaped band from the male member.

2 Claims, 10 Drawing Figures

METHOD AND APPARATUS FOR MAKING JEWELRY BANDS

This invention relates generally to jewelry making and in particular to a method and apparatus for making jewelry bands of various shapes.

Bands of various shapes are commonly used in jewelry. For example, gold and silver bands are commonly worn as a finger ornaments. In particular, square bands are frequently worn by persons with enlarged finger joints, such as those afflicted with arthritis, not only because of their unusual appearance, but because such bands can be turned diagonally to be slipped past an enlarged finger joint, and can then be worn as an ordinary ring by being turned so that parallel sides of the ring are between the fingers. In this position the ring will not rotate and will not slip past the enlarged joint.

At present, shaped bands, such as the square one described above, are manufactured by casting or by being cut from tubing of the desired cross-sectional shape. Unfortunately, casting is a relatively complex and expensive process which requires special molds and numerous forming steps for each band. Furthermore, tubing made of materials commonly used for jewelry is generally available only with a circular cross-section. Tubing with different cross-sectional shapes must, generally, be specially manufactured and becomes too expensive for manufacturing jewelry bands economically.

It is therefore an object of this invention to manufacture jewelry bands of various cross-sectional shapes frommaterials that are generally available to the jewelry industry.

It is another object of this invention to provide a simple and inexpensive, yet reliable, method for manufacturing jewelry bands of various shapes.

It is yet another object of this invention to provide an apparatus for repeatedly and reliably making jewelry bands of various shapes which is inexpensive in construction and easy to use.

The aforementioned shortcomings in the prior art are solved in accordance with the invention by making shaped bands by forming a generally available blank, such as an annular band, into the desired shape. The forming is achieved by forcibly sliding the ring onto the tapered front of an elongated member. From the front to the rear of the member, its cross-section gradually expands and assumes the approximate shape and size of the desired finished band. Thus, as the blank is slid from the front to the rear of the member, it is formed and somewhat stretched to the desired shape.

In accordance with an illustrative embodiment of the present invention, there is provided a tool for making jewelry bands of a generally square cross-section, which tool comprises a male member and a female member. The male member includes a shank or rear portion of square cross-section and of a size corresponding substantially to the size of the band that is to be produced, and a front portion which tapers from the shank toward the front of the member. The female member is generally planar and has a square aperture adapted precisely to receive the shank of the male member. In operation, an annular blank, for example one cut from cylindrical tubing, is placed over the aperture in the female member. The male member is then forced into the aperture in the female member so that the blank is formed into a rough square shape as it moves along the tapered portion of the male member and onto its shank. Next, the parallel sides of the blank are compressed between parallel jaws, such as those of a vise, to impart the final flat shape to the sides of the band and to release the corners of the band from the shank of the male member.

The foregoing brief description as well as further objects, features and advantages of the present invention are best appreciated by reading the following detailed description of a presently preferred, but nonetheless illustrative, embodiment in accordance with the invention, while referring to the accompanying drawing in which.

Figure 1:
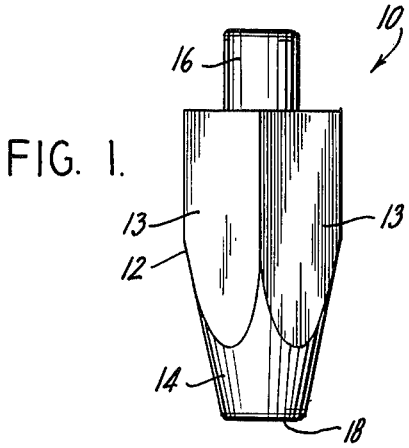
FIG. 1 is a plan view of an illustrative embodiment of the male member of the apparatus invention which is useful in forming a jewelry band having a square cross-section.
Figure 2:
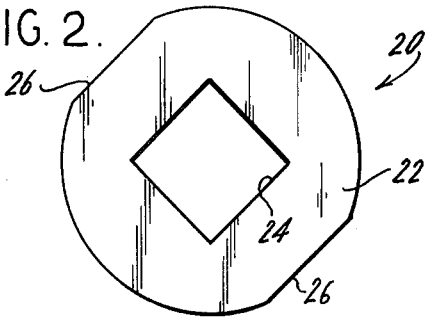
FIG. 2 is a top view of the female member of the apparatus invention which is used with the male member of FIG. 1.
Figure 7:
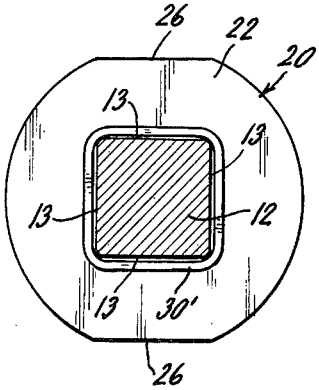
FIG. 7 is a sectional view taken along line 7—7 in FIG. 6 and looking in the direction of the arrows.
Figure 9:
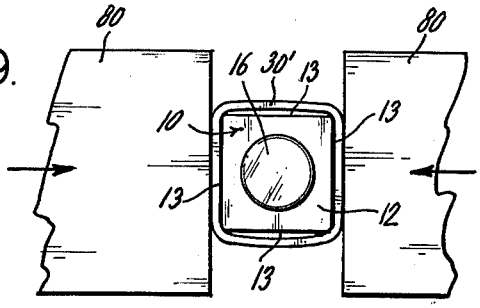
FIG. 9 is a top view of the apparatus of FIG. 8 further illustrating how the formed blank is compressed between parallel jaws.

Referring now to the details of the drawing, FIGS. 1 and 2 illustrate male and female members useful in forming a jewelry band of generally square cross-section according to the invention. The male member, indicated generally as 10, includes a rear or shank portion 12 having a series (four in the square shape of member 10) of flat faces 13, a front or transition portion 14 which is generally conical, and a mounting shaft 16. In the illustrative embodiment, the shank 12 of member 10 is rectangular in cross-section (see FIG. 7). However, the cross-sectional size and shape of shank 12 closely corresponds to the desired size and shape of the band and, therefore, can have any shape, including various polygonal or arcuate shapes. The transition portion 14 tapers from the shank 12 toward the front 18 of member 10, so that the front 18 is smaller in cross-section than the shank 12 and is smaller in diameter than the blank 30. Shaft 16 is provided at the rear of member 10 to permit the member 10 to be mounted in the receiving member of a press, or the like.

Female member 20 comprises a generally planar disc 22 which has an aperture 24 sized and shaped precisely to receive shank 12 of male member 10. Member 20 also includes a pair of parallel lateral edges 26, 26 which permit it to be mounted in a fixture on a press or clamped between parallel jaws of a vise in use.

Figure 3:
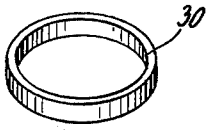
FIG. 3 is a perspective view showing an annular blank useful in forming a shaped band according to the invention.

As can be seen in FIG. 3, the blank 30 from which the shaped band is formed is in the form of an annular ring. Blank 30 is conveniently cut from cylindrical tubing which is readily available in conventional materials and in a wide range of sizes for use for jewelry making. When the blank 30 is formed, it is cut slightly larger than the finished axial dimension, in order to leave material for finishing. The diameter of the blank is selected to make the circumference of the blank correspond closely to, but preferably not exceed, the perimeter of the shaped band. This permits the band to be formed without excessive stretching, and consequent weakening, of material. If the circumference of the band is too large, the shaped band will be formed with bowed, instead of flat, sides.

Figure 4:
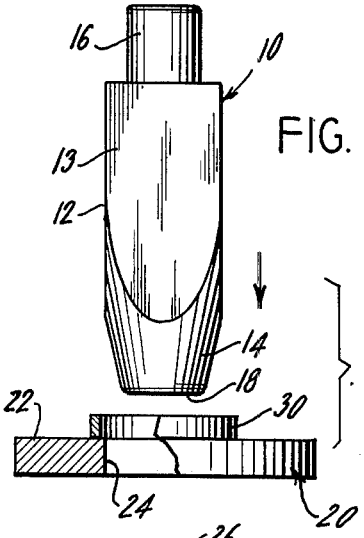
FIG. 4 is a side view, with parts broken away, showing the male and female members and the annular blank in the starting position for forming a shaped jewelry band.
Figure 5:
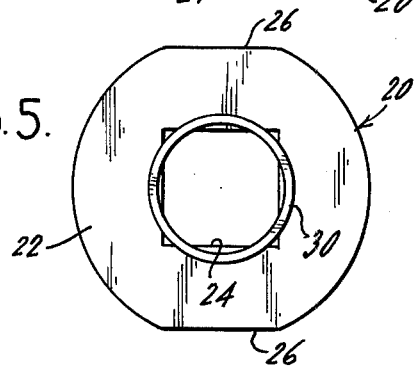
FIG. 5 is a top view of FIG. 4, with the male member removed, showing the annular blank in position over the aperture in the female member.

Referring now to FIGS. 4 and 5, there is shown the relative orientation of members 10 and 20 and blank 30 at the beginning of the formation of the shaped band. Shaft 16 of male member 10 is conveniently fastened in a press, or the like (not shown), for vertical movement in the direction of the arrow (FIG. 4). Female member 20 is supported in a generally horizontal position, for example by being held in a fixture in the base of a press or in the jaws of a vise (not shown), and the aperture 24 is centerd with respect to the axis of male member 10 and is oriented to receive shank 12 of member 10 therein. Blank 30 is rested on top of female member 20 and is generally centered with respect to aperture 24. To begin forming the shaped band, male member 10 is forced downwards towards female member 20 as indicated by the arrow (FIG. 4).

Figure 6:
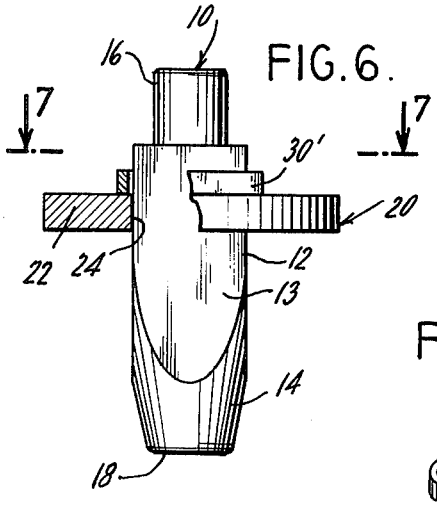
FIG. 6 is a side view similar to FIG. 4 showing the relationship of the male member, the female member and the blank after completion of the forming operation.
Figure 8:
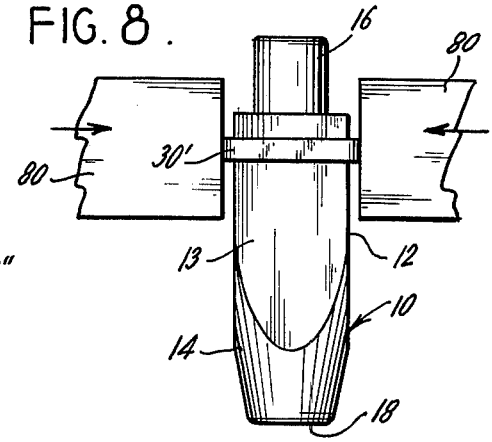
FIG. 8 is a side view with the female member removed, showing how the formed blank is compressed between parallel jaws.
Figure 10:
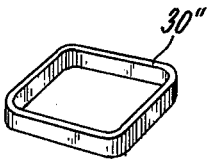
FIG. 10 is a perspective view of a jewelry band of generally square cross-section produced by the apparatus and method of the invention.

As male member 10 is forced into aperture 24 of female member 20, blank 30 slides up transition portion 14 of male member 10, and is shaped and somewhat stretched by the gradually flattening sides and expanding corners resulting from the intersection of the rectangular shank 12 with the generally conical transition position 14. After the shank portion of member 10 has passed through aperture 24 (see FIG. 6), the blank has been forced substantially onto shank portion 12 and, in the process, has been formed into a rough square band 30' with somewhat rounded corners and slightly bowed sides. As a result of the forming and stretching action of shank 12, the rough band 30' is firmly jammed on shank 12 at its corners.

As a final forming step, the rough shaped band 30' is compressed against the sides of the shank portion 12 of male member 10. In the case of the square cross-section band of the preferred embodiment, this is conveniently achieved by compressing opposite parallel sides between the parallel jaws 80, 80 of a vise or the like, and then rotating member 10 by 90° and compressing the two remaining parallel sides. This final compression step not only has the effect of making the sides of the formed band flat, but also serves to release the shaped band from the shank 12, as a result of the corners of the band being slightly separated as the bowing of the sides is eliminated. Thus, after the compression step, the shaped band easily slides down male member 10.

Where a ring is made with an odd number of sides or an arcuate shape, so that it cannot be compressed in a vise, the final flattening or compression can be achieved by use of a leather mallet, or the like, applied against the individual faces. Alternatively, a vise with shaped jaws or a pair of compression dies could be used for this purpose.

After the shaped band has been formed as described above, it is finished in accordance with normal jewelry manufacturing processes.

It has been found that best results are achieved and the amount of required final finishing is minimized by machining to a smooth finish the surface of male member 10 and the inner walls of aperture 24 of female member 20, and by machining the aperture 24 to as close a tolerance with respect to shank 12 as is consistent with smooth sliding action. The smooth finish reduces sliding resistance and abrasion or roughening of the inner surface of the ring, which would require additional finishing. If the close tolerance between the shank 12 and aperture 24 is not maintained, there is excessive clearance between the corners of the shank and aperture. As the blank is forced rearward onto the shank, a frictional force is exerted on the inner corners of the blank and toward the front of the male member, and this force tends to draw small slivers of the blank material into the excessive space between the corners of shank 12 and aperture 24. These slivers, and the additional machining required to remove them can be avoided by machining the shank 12 and aperture 24 to a close tolerance.

Although the invention has been described in terms of a specific embodiment for illustrative purposes, it will be appreciated by one skilled in the art that numerous additions, substitutions and modifications are possible without departing from the scope and spirit of the invention as defined in the accompanying claims. For example, the disclosed apparatus and method are readily adapted for forming bands having other than a square or rectangle cross-sectional shape, such as various polygonal and arcuate shapes. Also, before beginning the forming process the blank 30 need not necessarily be rested on the female member 20, but could be forced onto transition portion 14 of male member 10. The forming process would then proceed exactly as previously described.

What is claimed is:

1. A method of forming a blank band into a jewelry band having a different predetermined size and shape by employing an apparatus including a male member with a tapered front portion merging into a rear portion of said predetermined size and shape, and a planar female member having an aperture of said predetermined size and shape adapted to receive said male member, said method comprising the steps of:

positioning said blank for sliding movement on said male member;

forcing said male member and said female member into relative movement, so that said blank is moved along the front portion and onto the rear portion of said male member, thereby forming said blank substantially to said predetermined size and shape, and compressing said formed blank against the sides of said male member rear portion to produce a band of said predetermined size and shape.

2. An apparatus for forming a blank band into a jewelry band of predetermined size and shape different from said blank band, comprising: a male member having a front portion dimensioned to fit within said blank band, a rear portion having a cross section of said predetermined size and shape, and a transitional portion intermediate said front portion and said rear portion and adapted to allow for movement of said blank band relative to said male member; and a generally planar female member having an aperture therein of said predetermined size and shape.

* * * * *